US008091467B2

(12) United States Patent
Petronek

(10) Patent No.: US 8,091,467 B2
(45) Date of Patent: Jan. 10, 2012

(54) HYDRAULIC VALVE CIRCUIT WITH DAMAGE-CONTROL OVERRIDE

(75) Inventor: David W. Petronek, Boring, OR (US)

(73) Assignee: Cascade Corporation, Fairview, OR (US)

( * ) Notice: Subject to any disclaimer, the term of this patent is extended or adjusted under 35 U.S.C. 154(b) by 817 days.

(21) Appl. No.: 12/112,906

(22) Filed: Apr. 30, 2008

(65) Prior Publication Data

US 2009/0272257 A1 Nov. 5, 2009

(51) Int. Cl.
*F15B 11/20* (2006.01)

(52) U.S. Cl. ..... 91/517; 414/667; 414/699; 414/730; 414/741

(58) Field of Classification Search ..... 60/468; 91/517; 414/667, 699, 730, 741; 901/34, 901/37

See application file for complete search history.

(56) References Cited

U.S. PATENT DOCUMENTS

| | | | | |
|---|---|---|---|---|
| 3,180,514 | A | 4/1965 | Horton | |
| 3,704,800 | A | 12/1972 | Redelman | |
| 3,738,520 | A | 6/1973 | Didtel et al. | |
| 4,335,992 | A * | 6/1982 | Reeves | 414/667 |
| 4,467,894 | A | 8/1984 | Sinclair | |
| 5,139,385 | A * | 8/1992 | Chase et al. | 414/667 |
| 5,335,955 | A | 8/1994 | Pekka et al. | |
| 5,336,039 | A * | 8/1994 | House | 414/667 |
| 5,374,156 | A | 12/1994 | Simpson et al. | |
| 5,984,617 | A | 11/1999 | Seaberg | |
| 6,293,099 | B1 | 9/2001 | Kamiya | |
| 7,240,771 | B2 | 7/2007 | Perkins | |

FOREIGN PATENT DOCUMENTS

| | | |
|---|---|---|
| DE | 3801133 | 7/1989 |
| EP | 0959039 | 11/1999 |
| EP | 1122209 | 8/2001 |
| JP | 56 096100 | 7/1981 |
| JP | 05240205 | 9/1993 |

OTHER PUBLICATIONS

David W. Petronek; *Schematic Anti Spike*; Jul. 18, 2006; 1 page.
David W. Petronek; *Hydraulic Schematic/D Sliding Arm Clamp/ White Goods*; Oct. 31, 2007; 1 page.
Cascade Corporation; *Installation Instructions, Sequential Loop 3-Position Electronic Pressure Regulator Kits*; Oct. 2007; pp. 1-12.
Cascade Corporation; *Installation Instructions, Three-Position Pressure Relief Valve 660412*; Aug. 2004; pp. 1-2.

* cited by examiner

*Primary Examiner* — Daniel Lopez
(74) *Attorney, Agent, or Firm* — Chernoff, Vilhauer, McClung & Stenzel, LLP

(57) ABSTRACT

Hydraulic valve circuits capable of variably limiting respective maximum hydraulic pressures at which an assembly of bidirectional hydraulic power devices can move respective clamping members, such as forks or clamp arms, selectively in a closing movement toward each other, in an opening movement away from each other, or in a side-shifting movement in unison with each other, so as to provide damage-control capabilities for the control of the clamping members. The circuits preferably include one or more pressure-regulating valves interconnected with the assembly of power devices, and capable of variably limiting a maximum side-shifting pressure, at which said assembly can cause said side-shifting movement, in response to a maximum pressure selection. The circuits preferably include at least one override assembly, capable of overriding the maximum pressure selection to thereby lower the maximum side-shifting pressure automatically irrespective of the maximum pressure selection.

6 Claims, 3 Drawing Sheets

HYDRAULIC VALVE CIRCUIT WITH DAMAGE-CONTROL OVERRIDE

BACKGROUND OF THE INVENTION

This disclosure relates generally to hydraulic valve circuits for use with material handling equipment and, more particularly, to hydraulic valve circuits adapted to control transversely movable members such as forks or clamp arms associated with material handling equipment, and to provide damage-control override capabilities for the control thereof.

Material handling equipment used for moving palletized or non-palletized loads from place to place, such as, for example, in a warehouse, typically includes forklift trucks or other types of vehicles equipped with material handling attachments having load-lifting members such as forks or clamp arms. For example, on a typical forklift truck, load-lifting forks are attached to a carriage which is in turn movably attached to a mast so as to travel vertically for raising and lowering the forks. Various different types of attachments may also be mounted on the carriage. For example, a fork side-shifter which moves the forks transversely in unison, and a fork positioner which moves the forks transversely toward and away from each other, may be attached to the carriage, either separately or as an integrated unit. Alternatively, a load clamp having load-engaging clamp arms similarly movable transversely either in unison, or toward and away from each other, may be attached to the carriage. Such general types of equipment, as well as those more specifically described hereafter, all constitute exemplary applications in which the hydraulic circuits described herein are intended to be used.

Different types of load-lifting forks and clamp arms are available for these purposes. For example, drum-clamping forks may incorporate contours particularly useful for clamping barrels or drums. Similarly, clamp arms may be engineered differently for handling rectangular or cylindrical loads. More specifically, clamp arms adapted to handle rectangular loads such as stacked cartons or household appliances are generally referred to as carton clamps and rely on clamping forces applied to the sides of the rectangular load for lifting the load. Carton clamp attachments typically include a pair of large blade-shaped clamp members each of which can be inserted between side-by-side stacks of cartons or appliances. The clamp members on either side of the load are then drawn together, typically using hydraulic cylinders for controlling the movement of the clamp members, to apply a compressive force on the load of sufficient pressure to allow for lifting the load using the clamp members compressively engaged with the sides of the load. The surfaces of the clamp members which contact the sides of the load are typically constructed of materials such as rubber faced aluminum that provide a high coefficient of friction to securely hold the load. Carton clamps are most frequently used in the warehousing, beverage, appliance, and electronics industries and may be specifically designed for particular types of loads. For example, carton clamps may be equipped with contact pads that are sized for palletless handling of refrigerators, washers, and other large household appliances (also referred to as "white goods"). In various configurations, carton clamps may be used for handling multiple appliances at one time.

In addition to clamping a load in order to lift and move the load, carton clamps may be equipped with side-shifting capabilities whereby the clamped load may be repositioned from side-to-side with the clamping members moving transversely in one direction or the other in unison. The side-shifting function may be actuated by one or more hydraulic cylinders separate from the clamping cylinder ("external" side-shifting), or by the clamping cylinders themselves ("internal" side-shifting). After a particular load is grasped and lifted by the clamping members, moved to a new location, and perhaps side-shifted toward one side or the other, the operator of the forklift or other material handling vehicle fitted with the carton clamp attachment might then lower the load, release the clamp pressure, and thereafter decide that repositioning of the load is needed. For example, the load may need to be repositioned to sit flush against a trailer or railcar wall. To reposition the load, the operator may contact the load with an outward side surface of one of the clamp members and then turn the vehicle toward the load, causing the outward surface of the clamp member to urge the load to move transversely (in a maneuver referred to as "pinwheeling"). Alternatively, the operator may contact the load with an outward side surface of one of the clamp members and then use either a clamp opening movement or a side-shifting movement toward the load to cause the outward surface of the clamp member to reposition the load transversely (in a maneuver referred to as "backhanding").

Damage to the load may occur in various ways. The operator may use too little clamping force when attempting to grasp and then lift the clamped load. As a result the load may become dislodged from the clamping members and sustain impact damage. A more likely scenario involves the operator using too much clamping force in an effort to avoid dropping the load. The result of using too much clamping force may be a crushed or deformed load.

Damage to the load or to adjacent structures such as surrounding walls or trailers, railcars, containers or warehouses, may also occur if excessive pinwheeling or backhanding force is applied. For example, using too much force to reposition a load against a trailer wall might result in crushing or deforming the load as it is compressed between the outward surface of one of the clamp members and the trailer wall, or deforming or even breaking the trailer wall itself.

To prevent the operator of a material handling vehicle, equipped with any of the foregoing load-handling attachments, from accidentally causing such damage to a load or to an adjacent structure, hydraulic override valve circuits are needed that are adapted to limit the compressive forces that may be applied to the side of a load by forks, clamp arms, or similar load-handling members, not only to limit clamping forces but also to limit pinwheeling or backhanding forces which may be applied to the side of the load when repositioning the load.

BRIEF DESCRIPTION OF THE SEVERAL DRAWINGS

For a more complete understanding of the present invention, the drawings herein illustrate examples of the invention. The drawings, however, do not limit the scope of the invention. Similar references in the drawings indicate similar elements.

DETAILED DESCRIPTION OF PREFERRED EMBODIMENTS

In the following detailed description, numerous specific details are set forth in order to provide a thorough understanding of the preferred embodiments. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Figure 1:
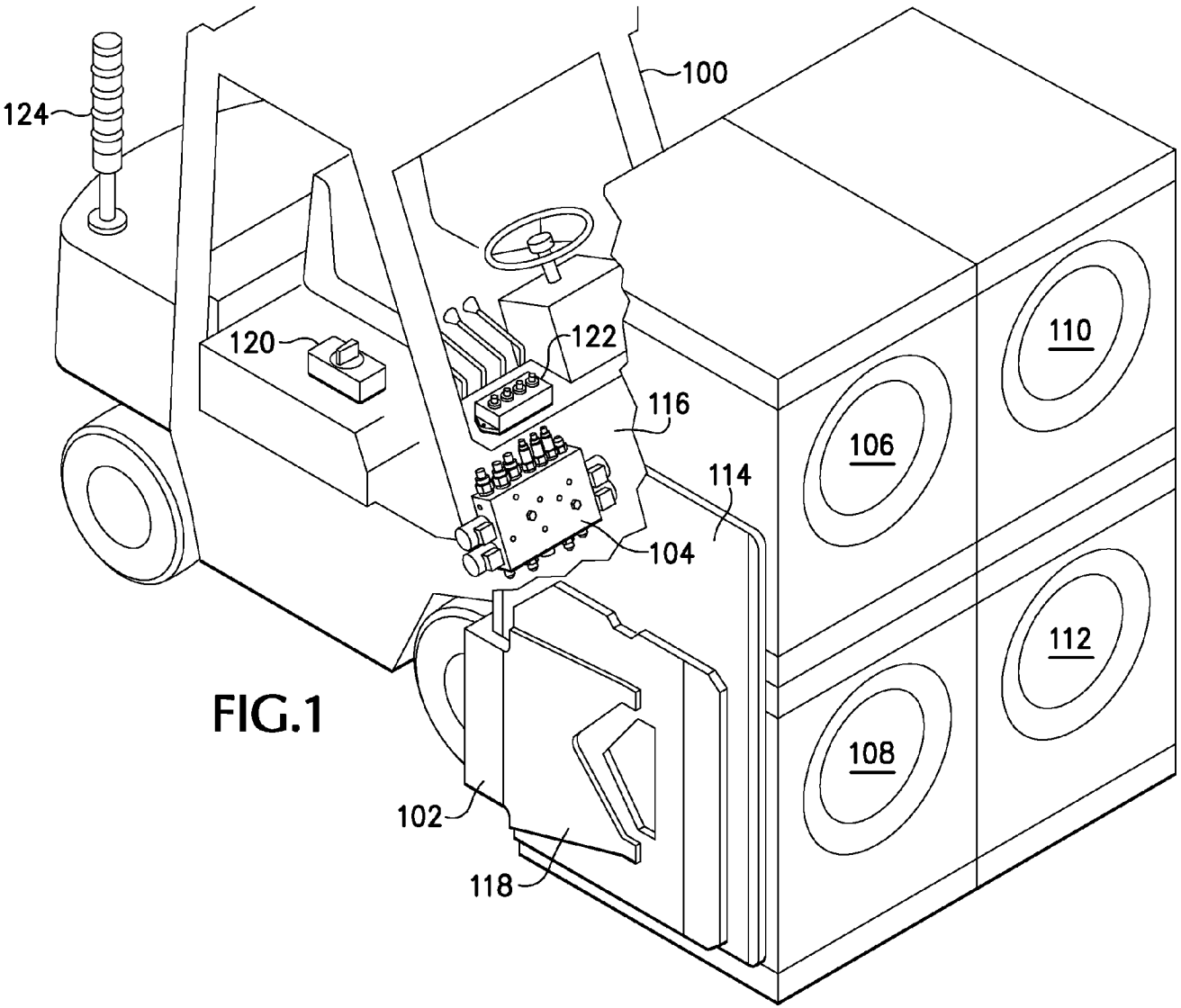
FIG. 1 is a perspective view of an exemplary forklift truck fitted with a carton clamp attachment and having a hydraulic valve module with damage control override according to one embodiment.
Figure 2:
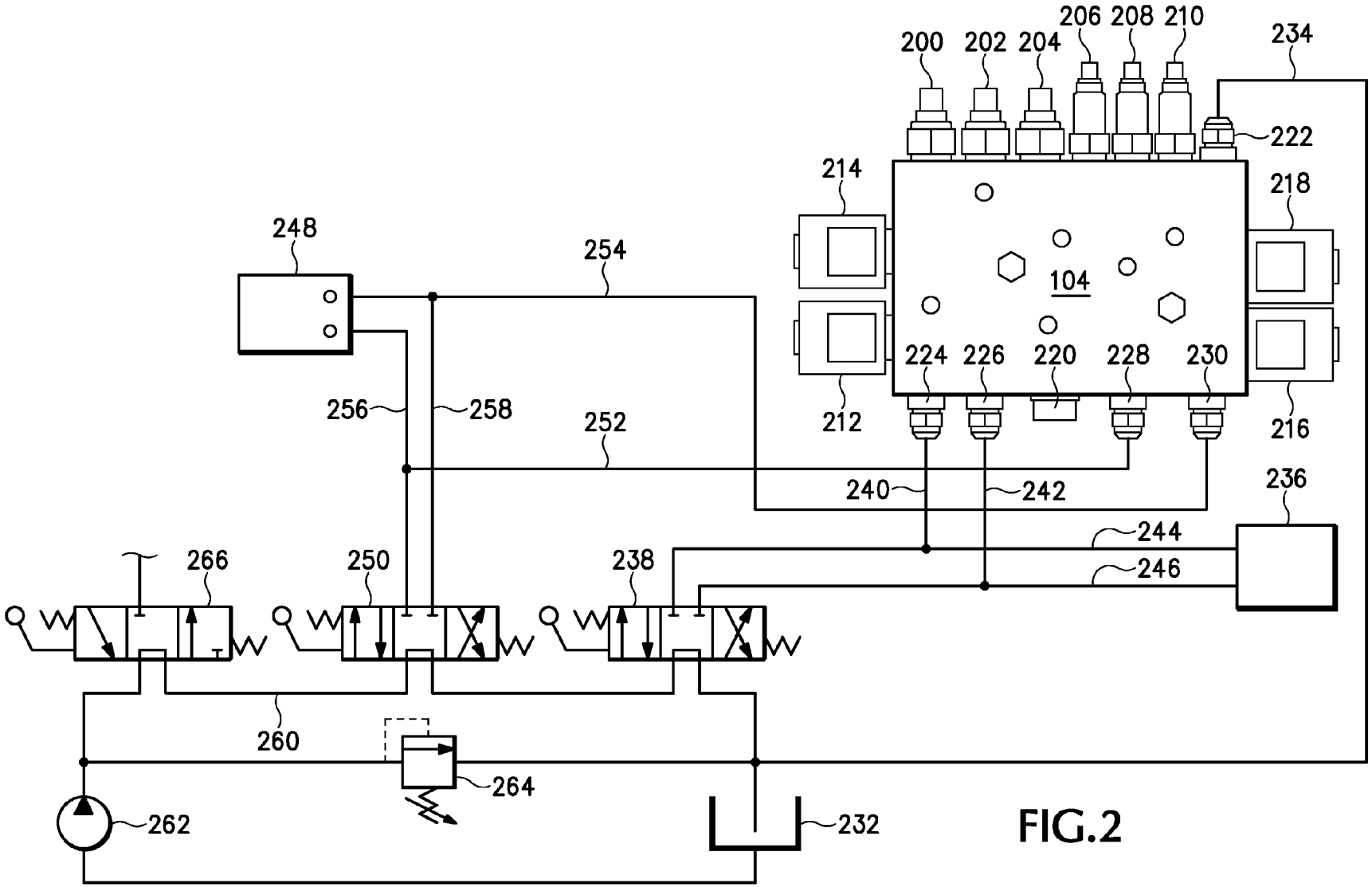
FIG. 2 is an exemplary installation schematic for the hydraulic valve module in FIG. 1.
Figure 3:
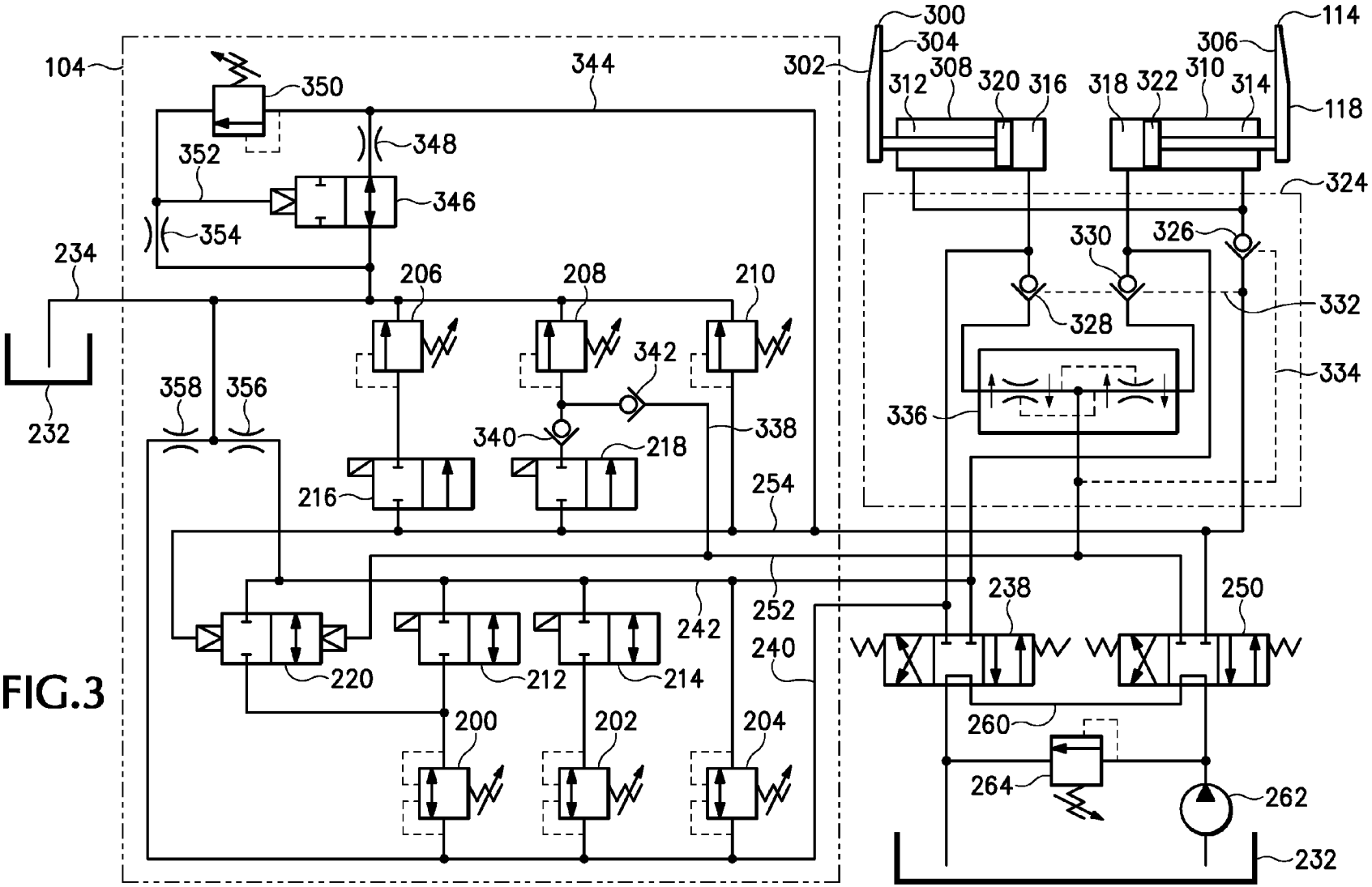
FIG. 3 is an exemplary detail circuit diagram of a clamping and side-shifting system having a hydraulic valve circuit with damage control override, according to a preferred embodiment.

As an overview, the preferred embodiments generally involve hydraulic valve circuits adapted to control load-handling members, such as forks or clamp arms, associated with material handling equipment. Preferably, the hydraulic valve circuits may be used for any type of hydraulic device having sliding or pivoting load-handling members and having variably selectable maximum forces with which the load-handling members move toward and away from each other. Although the preferred embodiments may be implemented in a wide variety of configurations involving different types of material handling attachments, the following detailed description discloses the preferred embodiments principally in the context of an exemplary forklift truck 100, as illustrated in FIG. 1, fitted with a carton clamp attachment 102 and having a hydraulic valve module 104. FIGS. 2 and 3 provide installation detail for the hydraulic valve module 104 and exemplary detailed circuitry for a clamping and side-shifting system having a hydraulic valve circuit with damage control override capabilities.

As shown in FIG. 1, the carton clamp attachment 102 is configured for handling white goods such as the four washers 106, 108, 110, 112 clamped between a first clamping member 114 (sometimes referred to as a clamp arm having a contact or clamp pad, which is shown engaging two of the washers 106, 108) and a second, oppositely oriented clamping member (not shown), which is hidden in this perspective view (by two of the washers 110, 112). A portion of the first clamping member 114 is shown cut away so as to better reveal the hydraulic valve module 104 and its preferable mounting on the forklift truck cowl panel 116. The carton clamp attachment 102 may be attached to a carriage (not shown), and the carriage may be attached to a mast assembly (not shown) mounted to the front of the forklift truck 100. Neither the carriage nor the mast assembly is shown in FIG. 1 in order to better illustrate the preferred location of the hydraulic valve module 104. However, such carriage and mast assembly structures are well known and need not be described in further detail.

The carton clamp attachment 102 includes a pair of large blade-shaped clamp members, shown schematically as 114 and 300, in FIG. 3 and shown structurally as member 114 in FIG. 1, which can be inserted between side-by-side stacks of appliances such as the washers 106, 108, 110, 112 shown in FIG. 1. The clamp members on either side of the load (i.e. the washers 106, 108, 110, 112) are drawn together, using hydraulic cylinders and clamp-closing hydraulic circuitry shown schematically in FIG. 3, to apply a compressive force on the load with sufficient pressure to enable the clamp members to lift the load frictionally. The carton clamp attachment 102 is preferably equipped with side-shifting capabilities whereby the clamped load may be repositioned from side-to-side with the clamping members moving transversely in unison. As will be discussed in greater detail, the side-shifting capabilities are preferably of an internal type, using the same hydraulic cylinders for both clamping and side-shifting movements, but may also be of an external type for example, using separate hydraulic cylinders for clamping and side-shifting movements respectively.

In operation, after the load is initially clamped and lifted by the clamping members, moved to a new location, and perhaps side-shifted toward one side or the other, the operator of the forklift 100 may lower the load, release the clamp pressure, and thereafter decide whether further repositioning of the load is needed. For example, the load may need to be further repositioned to sit flush against a trailer wall. To further reposition the load, the operator may contact the load with an outward surface 118 of one of the clamp members 114 and use a clamp opening movement, a side-shifting movement or a pinwheeling maneuver to cause the outward surface 118 of the clamp member 114 to push the load in a sideways direction (i.e. to the right as viewed by an operator sitting in the forklift 100 in FIG. 1).

Damage to a load, and/or to adjacent loads and structures during the foregoing initial clamping and subsequent repositioning operations can occur due to any of several possible causes. Such causes include excessive clamping force when clamping and lifting the load (resulting in over compression of the load), insufficient clamping force (resulting in load dislodgement), or excessive clamp-opening backhanding, side-shifting backhanding, or pinwheeling repositioning forces (resulting in deformation of the load and/or adjacent loads or structures). The present inventor has invented hydraulic valve circuits useful to automatically minimize these causes by means of override capabilities associated with these hydraulic valve circuits. Because minimizing some of these causes competes with minimizing others of these causes, the inventor has further designed these hydraulic circuits with predetermined priorities to which the various override capabilities are responsive, so as to insure that minimization of the most potentially damaging cause in a particular operational situation is automatically favored.

In a preferred embodiment, a hydraulic valve circuit with override capabilities may be implemented as a hydraulic valve module 104 as shown in FIG. 1, mounted on the cowl panel 116 of a forklift truck 100. The hydraulic valve module 104 may be part of a an electric/hydraulic valve system whereby an operator of the forklift 100 may adjust a switch 120 to one of multiple pressure settings to remotely control the maximum amount of force to be used. In one embodiment, the switch 120 may control respective solenoid valves which control clamp pressure-regulating and side-shift pressure regulating valve assemblies respectively, so as to limit the amount of available clamping force and side-shift force based on the actuation of the solenoids. In one embodiment, for example, the switch 120 may have high, medium, and low pressure settings, and an in-cab light bar 122 may be used to show the driver which setting is active. A light tower 124 may be used for providing a long range visible indication of which pressure setting is active.

The hydraulic valve module 104 preferably provides, as mentioned, three electrically selectable maximum clamping pressures. For example, the operator of the lift truck 100 may use the selector switch 120, which may be mounted anywhere within convenient reach of the operator, to manually select from high, medium, or low level clamping pressure settings. A higher clamping pressure setting may be used for heavier loads so as to reduce the possibility of load dislodgement. A lower clamping pressure setting may be used for lighter or more easily deformed loads, thereby reducing the possibility of damaging the load by using excessive clamping force.

The hydraulic valve module 104 also preferably provides clamp-opening backhanding damage protection by including hydraulic circuitry to limit the amount of clamp-opening force available. Preferably, hydraulic pressure in the clamp-opening fluid conduit is limited by a medium level clamp pressure-regulating valve to thereby limit the clamp-opening force to be the same as the medium level clamp-closing (or clamping) pressure setting. With such clamp-opening backhanding protection, the hydraulic valve module 104 limits the pressure that may be applied by the outward surface 118 of the clamp member 114 during a clamp opening movement, thereby reducing damage that might otherwise occur without such clamp-opening force limitation. When the operator, for example, contacts a load with the outward surface 118 of the clamp member 114 and then opens the clamp member 114 so that it pushes the load to the side, the amount of clamp-opening backhanding force for pushing the load is automatically limited.

The hydraulic valve module 104 preferably also provides side-shift backhanding, as well as pinwheeling, damage protection by including hydraulic circuitry to limit hydraulic pressure in the side-shifting fluid conduits. The hydraulic valve module 104 preferably provides three electrically selectable maximum side-shifting or pinwheeling pressures. A higher pressure setting may be used for heavier loads because too low a pressure may prevent effective side-shifting or pinwheeling of such heavier loads, or cause the side-shifting to be overly slow. A lower side-shifting pressure setting may be used for lighter loads.

To prevent excessive side-shift or pinwheeling pressure when the forklift has no clamped load, the hydraulic valve module 104 includes override circuitry interconnected with the side-shift fluid conduits that is capable of overriding any high side-shift pressure selection automatically in response to a clamp opening movement. For example, the override assembly may include an override valve that automatically actuates a low level side-shift pressure setting in response to clamp opening even when the forklift operator may have inadvertently set the switch 120 to a higher pressure setting prior to or during side-shifting of a load. With such side-shifting backhanding and pinwheeling pressure protection, the hydraulic valve module 104 limits the force that may be applied by the outward surface 118 of the clamp member 114 to a load by side-shift backhanding movement, or by pinwheeling, thereby preventing damage that might otherwise occur.

The valve module 104 also prevents excessive side-shift pressure when the forklift has a clamped load, without thereby disabling side-shifting capability (which depends on load weight). In a preferred embodiment, the override valve is deactivated by the clamp closing movement so that the forklift operator can choose from among three side-shift pressure relief settings calibrated to barely side-shift loads of selected high, medium and low weight. Preferably, maximum clamping force is matched with maximum side-shifting pressure so as to provide minimal side-shifting pressure corresponding to the weight of the load being handled.

Not all side-shift damage is caused from backhanding and pinwheeling. An example is the potential for dropping a clamped load at the end of side-shift or during side-shifting when using an internal type side-shifter whereby the same bidirectional hydraulic cylinders perform both clamping and side-shifting functions. When a load is clamped, the rod sides of the cylinders contain the clamping pressure. During side-shifting of the clamped load, pressure is added to the head side of one of the cylinders causing the rod-side pressure of that cylinder to increase. Side-shifting occurs as hydraulic fluid flows from the rod side of one cylinder to the rod side of the other cylinder while maintaining the distance between clamp members (and the rods connected thereto). However, the increased rod-side pressure in one or both of the cylinders tends to cause hose swell and compressing of air and/or oil in the rod side of the cylinder. This may result in slight rod movement away from the other rod, causing clamp pressure to drop as rod-side pressure increases. If the drop in clamp pressure is sufficient, it is possible to drop the load.

Clamp pressure may also drop when one of the bidirectional hydraulic cylinders reaches its end of stroke. There is a tendency for clamp pressure to drop at the end of the side-shift stroke. For example, if the trailing (or following) cylinder reaches its stop or end-of-travel before the leading cylinder reaches its stop or end-of-travel, the clamp pressure may drop as the leading cylinder continues to side-shift. In such a situation, the clamp members may spread apart from one another due to the loss of clamping pressure, possibly resulting in dropping or dislodgement of the load.

Clamp pressure may also drop due to movement caused by pressure intensification. During the normal clamp cycle, the head-side pressure is at zero psi. Any attempt to side-shift adds pressure at the head side. Given that the head-side surface area (i.e. the surface area of the head-side of the piston within the cylinder) is greater than the rod-side area, a pressure intensification results, which tends to compress oil and/or air and swell the hydraulic hoses. Compression of the volume of oil and/or air, for example, in the rod side may cause the rods to move apart from one another and, consequently, a loss of clamp pressure.

The present inventor discovered that limiting the amount of available side-shift pressure limits the amount of available pressure that may cause a drop in clamping pressure. Preferably, the hydraulic valve module 104 includes override circuitry capable of overriding the maximum side-shift pressure selection automatically in response to a clamp opening movement, and disabling the override function in response to a clamp closing movement. In one embodiment, the override circuitry includes a shuttle-type (or "latching") bidirectional valve which is piloted from both the clamp-closing conduit and the clamp-opening conduit. In response to clamp-closing pressure, the valve moves to a closed or deactivated state permitting selection of different maximum side-shift pressures. In response to clamp-opening pressure, the valve moves to an open or activated state, thereby overriding the maximum side-shift pressure selection so that the maximum side-shift pressure is limited to the lowest side-shift pressure level.

With reference to FIGS. 2 and 3, the hydraulic valve module 104 preferably includes six pressure-regulating valve cartridges 200, 202, 204, 206, 208, 210, each of which may be variably calibrated to a particular pressure relief setting. Three of the cartridges 200, 202, 204 provide variably selectable side-shift pressure relief, and the other three cartridges 206, 208, 210 provide variably selectable clamp pressure relief. Preferably, four solenoid-operated selector valves 212, 214, 216, 218 are also provided. Two of the solenoid-operated valves 212, 214 correspond to the side-shift pressure-regulating valves, and the other two solenoid-operated valves 216, 218 correspond to the clamp pressure-regulating valves. Preferably, a shuttle-type latching override valve 220 is also provided, which will be described in further detail below in terms of its override operation and its interconnection with the side-shifting fluid conduits and clamp-closing and clamp-opening fluid conduits. The hydraulic valve module 104 preferably includes five ports—a return-to-tank port 222, a pair of side-shift ports 224, 226, a clamp-opening port 228, and a clamp-closing port 230.

As shown in FIG. 2, the return-to-tank port 222 is interconnected with the truck hydraulic fluid tank 232 using a return-to-tank hydraulic conduit 234. The side-shift ports 224, 226 of the hydraulic valve module 104 are shown interconnected with corresponding side-shift attachment ports 236 as well as corresponding ports on a side-shift control valve 238 using side-shift hydraulic conduits 240, 242 that are tee connected into side-shift hydraulic conduits 244, 246. The side-shift ports 224, 226 of the hydraulic valve module 104 are each preferably capable of receiving hydraulic fluid from and returning hydraulic fluid to the hydraulic valve module 104 and the hydraulic circuitry thereof. The clamp-opening port 228 and clamp-closing port 230 of the hydraulic valve module 104 are shown interconnected with corresponding attachment ports 248 as well as corresponding ports on a clamp control valve 250 using clamp-opening and clamp-closing hydraulic conduits (252 and 254, respectively) that are tee connected into clamp-opening and clamp-closing hydraulic conduits (256 and 258, respectively). The clamp-opening and clamp-closing ports (228 and 230, respectively) of the hydraulic valve module 104 are each preferably capable of receiving hydraulic fluid from and returning hydraulic fluid to the hydraulic valve module 104 and the hydraulic circuitry thereof.

Also shown in FIG. 2 is an exemplary hoist control valve 266. All three of the control valves—the side-shift control valve 238, the clamp control valve 250, and the hoist valve 266—are preferably three-position lever actuated spring-centered valves of the type commonly used in lift truck applications and, in particular, forklift trucks fitted with clamp and side-shift attachments. Such valves may be interconnected, as shown, with a hydraulic fluid supply conduit 260, which may receive hydraulic fluid from a truck hydraulic pump 262 and return hydraulic fluid to the truck hydraulic fluid tank 232, and with an adjustable truck pressure relief valve 264 that diverts hydraulic fluid to the truck hydraulic fluid tank 232 when hydraulic pressure in the supply conduit 260 exceeds a pressure relief setting for the truck pressure relief valve 264.

The solenoid-operated valves 212, 214, 216, 218 are preferably normally closed bidirectional solenoid-operated valves electrically connected to truck battery and the three-position switch 120. Preferably, each of the solenoid-operated valves 212, 214, 216, 218 includes an outwardly visible indicator to show whether the valve is in an activated (i.e. open) or inactivated (i.e. closed) position. For instance, each of the solenoid-operated valves 212, 214, 216, 218 may include a light within the portion of the valve that extends from the main valve body of the module 104, and the light may illuminate when the solenoid is activated (or energized). The electrical wiring and connections required for actuating the solenoids may, for example, include fuses, relays, and other components or may involve more complex electrical systems such as multiplexing systems, e.g. Controller Area Network Bus (CAN-Bus) systems, designed to reduce the amount of wiring and other components required for interconnecting and operating various controllable features on a lift truck such as the forklift 100. Various methods for electrically selectably controlling the solenoid-operated valves 212, 214, 216, 218 (and for interconnecting other features such as the manually operated selection switch 120, the in-cab light bar 122, and the light tower 124) may be used. Such methods are generally well known and are therefore not described in further detail herein.

In a preferred embodiment, a low pressure position of the selection switch 120 energizes the solenoid-operated valve 212 corresponding to a low pressure-regulating valve 200 for limiting side-shift pressure to a low pressure setting and, simultaneously, energizes the solenoid-operated valve 216 corresponding to a low pressure-regulating valve 206 for limiting clamp-closing pressure to a low pressure setting. Likewise, a medium pressure position of the selection switch 120 preferably energizes the solenoid-operated valve 214 corresponding to a medium pressure-regulating valve 202 for limiting side-shift pressure to a medium pressure setting and, simultaneously, energizes the solenoid-operated valve 218 corresponding to a medium pressure-regulating valve 208 for limiting clamp-closing pressure to a medium pressure setting. Finally, a high pressure position of the selection switch 120 preferably corresponds to a condition where none of the solenoids 212, 214, 216, 218 are energized and provides a high pressure-regulating valve 204 for limiting side-shift pressure to a high pressure setting and, simultaneously, a high pressure-regulating valve 210 for limiting clamp-closing pressure to a high pressure setting.

With regard to operation of the above mentioned solenoids, according to one embodiment, an operator of the forklift 100 may select low pressure relief settings for clamp and side-shift forces by positioning the selection switch 120 to a low pressure relief position. Both the low side-shift pressure relief solenoid 212 and low clamp pressure relief solenoid 216 are then energized thereby exposing the low side-shift pressure relief valve 200 to fluid pressure in the side-shift hydraulic conduits 240, 242 and exposing the low clamp pressure relief valve 206 to fluid pressure in the clamp-closing hydraulic conduit 254. At that point, according to one embodiment, both the low side-shift pressure relief valve 200 and the high side-shift pressure relief valve 204 are exposed to fluid pressure in the side-shift hydraulic conduits 240, 242, and both the low clamp pressure relief valve 206 and the high clamp pressure relief valve 210 are exposed to fluid pressure in the clamp-closing hydraulic conduit 254. However, as will be discussed in further detail with respect to FIG. 3, side-shift and clamp-closing pressures are limited by the low side-shift pressure relief valve 200 and the low clamp pressure relief valve 206, respectively, unless the low pressure relief solenoids 212, 216 are no longer energized, in which case the side-shift and clamp-closing pressures are limited by the medium side-shift pressure relief valve 202 and the medium clamp pressure relief 208, respectively, if the medium pressure relief solenoids 214, 218 are energized, or the side-shift and clamp-closing pressures are limited by the high side-shift pressure relief valve 204 and the high clamp pressure relief valve 210, respectively, if none of the solenoids 212, 214, 216, 218 are energized. When the low pressure relief solenoids 212, 216 are energized, hydraulic fluid is diverted from the clamp-closing port 230 to the return-to-tank port 222 (and back to the truck hydraulic fluid tank 232 via return-to-tank hydraulic conduit 234) if pressure in the clamp-closing hydraulic conduit 254 exceeds the pressure setting for the low clamp pressure relief valve 206. Further when the low pressure relief solenoids 212, 216 are energized, hydraulic fluid is diverted from one of the side-shift ports 224, 226 to the other if pressure received by the former exceeds the pressure setting for the low side-shift pressure relief valve 200.

FIG. 3 is an exemplary detail circuit diagram of a clamping and side-shifting system having hydraulic valve circuitry with override capabilities, according to a preferred embodiment. As shown, oppositely oriented clamping members 300, 114 have outward surfaces 302, 118 that may be used for pinwheeling or backhanding a load and load-contacting surfaces 304, 306 that may be used for clamping a load. The clamping members 300, 114 are movably controlled by respective hydraulic power devices such as hydraulic cylinders 308, 310. The hydraulic cylinders 308, 310, as shown, are characterized as having rod sides 312, 314 and head sides 316, 318 between which pistons 320, 322 are able to travel. For example, as hydraulic fluid is directed into the rod side (or rod end) 314 of the cylinder 310 controlling the movement of the clamping member 114 shown on the right side (in FIG. 3), the piston 322 is driven to the left, thereby moving the clamping member 114 toward the other clamping member 300. Likewise, as hydraulic fluid is directed into the rod side 312 of the cylinder 308 controlling the movement of the clamping member 114, the piston 320 associated with the left clamping member 300 is driven to the right, thereby moving the clamping member 300 toward the opposite clamping member 114.

The clamping and side-shifting hydraulic circuitry 324 shown in FIG. 3 provides clamp-closing, clamp-opening, and side-shifting control for the two clamping members 300, 114 via the two bidirectional hydraulic cylinders 308, 310. Clamp-closing movement is provided by positioning the clamp control valve 250 so that hydraulic fluid unseats the pilot-operated check valve 326 and flows into the rod sides 312, 314 of the clamping cylinders 308, 310. Hydraulic fluid is able to drain from the head sides 316, 318 of the cylinders 308, 310 (thereby allowing movement of the pistons 320, 322 in a clamp closing movement) when the pilot-operated check valves 328, 330 are unseated in response to the clamp-closing conduit (or clamp conduit) signal received through the pilot conduit 332 that is interconnected with the hydraulic clamp-closing conduit extending from the clamp control valve 250. A flow divider/combiner 336 is preferably included to provide even flow of clamp-closing fluid from (or to) the head sides 316, 318.

Clamp-opening movement is provided by positioning the clamp control valve 250 so that hydraulic fluid flows through the flow divider/combiner 336, unseats the check valves 328, 330, and flows into the head sides 316, 318 of the cylinders 308, 310. Hydraulic fluid is able to drain from the rod sides 312, 314 of the cylinders 308, 310 (thereby allowing movement of the pistons 320, 322 in a clamp opening movement) when the pilot-operated check valve 326 is unseated in response to the clamp-opening conduit (or open conduit) signal received through the pilot conduit 334 that is interconnected with the hydraulic clamp-opening conduit extending from the clamp control valve 250.

Side-shifting movement is provided by positioning the side-shift control valve 238 so that hydraulic fluid flows into one of the head sides 316, 318 of the cylinders 308, 310 causing hydraulic fluid to flow from the rod side of one cylinder to the rod side of the other cylinder. For example, positioning the side-shift control valve 238 so that hydraulic fluid is pumped into the head side 318 of the cylinder 310 associated with the clamping member 114 causes increased pressure in the rod side 314 of the cylinder 310, hydraulic fluid flow from the rod side 314 to the other rod side 312 of the other cylinder 308, hydraulic fluid flow from the head side 316 of the cylinder 308 to the side-shift control valve 238 and to the truck hydraulic fluid tank 232, and, consequently, side-shift movement of the clamping members 300, 114 to the right. Likewise, positioning the side-shift control valve 238 so that hydraulic fluid is pumped into the head side 316 of the cylinder 308 associated with the clamping member 300 causes side-shift movement of the clamping members 300, 114 to the left.

As previously mentioned, using the same cylinders for both clamping and side-shifting is referred to as internal side-shifting. Although internal side-shifting is preferred due to complexity and other factors, external side-shifting may be used. For external side-shifting (not shown), the clamping and side-shifting hydraulic circuitry 324 would not include interconnections between the side-shift control valve 238 and head sides 316, 318 as shown but might instead include an additional bidirectional cylinder interconnected with the side-shift control valve 238 for moving both clamping members 300, 114 together (perhaps with the clamping members 300, 114 and associated cylinders 308, 310 mounted on a separate frame) so that a load clamped between the load-contacting surfaces 304, 306 may be side-shifted in response to the side-shift control valve 238.

As shown in FIG. 3, the hydraulic valve module 104 preferably includes circuitry interconnected with five hydraulic fluid conduits—a return-to-tank (or return-to-reservoir) conduit 234, a pair of side-shift fluid conduits 240, 242, a clamp-opening (or open) conduit 252, and a clamp-closing (or clamp) conduit 254. The pair of side-shifting fluid conduits 240, 242 are preferably capable of receiving hydraulic fluid from and returning hydraulic fluid to the side-shifting hydraulic circuitry 324. As shown, side-shift pressures are selectably limited by one of three variably adjustable bidirectional pressure relief valves 200, 202, 204, which are interconnected in parallel with one another between the right side-shift fluid conduit 242 and the left side-shift fluid conduit 240. The bidirectional solenoid-operated valves 212, 214 (shown in FIG. 3 as normally closed type valves) are used to actuate the low and medium pressure relief valves (200 and 202, respectively). If neither of the solenoids 212, 214 are actuated (i.e. opened), then side-shift pressure is limited by the pressure relief valve 204.

Preferably, the bidirectional pressure relief valves 200, 202, 204 limit side-shifting in either direction to low, medium, and high pressure settings, respectively. For example, if the solenoid valve 212 is energized (to open the valve), the side-shift pressure in either direction (i.e. in either right side-shift fluid conduit 242 or left side-shift fluid conduit 240) will be limited to the (low) pressure setting of the bidirectional relief valve 200. If the (low) pressure setting is exceeded, hydraulic fluid from the side-shift fluid conduit having the excessive pressure will be diverted to the other side-shift fluid conduit. If the solenoid valve 214 is energized, the side-shift pressure will be limited to the (medium) pressure setting of the bidirectional relief valve 202. Finally, if neither solenoid valve is opened, the side-shift pressure will be limited to the (high) pressure setting of the bidirectional relief valve 204.

Preferably, an override assembly is provided for automatically limiting the amount of side-shift pressure whenever the clamp members 300, 114 are not clamping a load. A shuttle-type latching override valve 220 may be used to divert hydraulic fluid around the low pressure solenoid valve 212 in response to an open conduit signal. As shown, the shuttle-type latching override valve 220 is piloted by both the clamp-opening conduit 252 (to open the valve 220 to cause a bypass of the solenoid valve 212) and the clamp-closing conduit 254 (to close the valve 220 to disable the bypass of the solenoid valve 212). The shuttle-type latching override valve 220 preferably has no spring and, therefore, no "normal" state. Instead the latching valve 220 remains in either an open or closed position until closed or opened in response to a clamp-closing signal or a clamp-opening signal.

As shown, flow restrictors 356, 358 may be used for restricted leakage of hydraulic fluid from the right and left side-shift fluid conduits 242, 240, respectively, back to the return-to-tank conduit 234. The flow restrictors 356, 358 allow pressure in the side-shift fluid conduits 242, 240 to drop to zero psi when not side-shifting. The flow restrictors 356, 358 may also prevent pressure from becoming trapped in the side-shift fluid conduits 240, 242 and head sides 316, 318

(when there is a clamped load), potentially creating forces opposed to (rod-side) clamping forces.

The clamp-closing (or clamp) conduit 254 is preferably capable of receiving hydraulic fluid from the clamping hydraulic circuitry 324. As shown, clamp-closing pressures are selectably limited by one of three variably adjustable pressure relief valves 206, 208, 210, which are interconnected in parallel with one another between the clamp-closing fluid conduit 254 and the return-to-tank fluid conduit 234. The solenoid-operated valves 216, 218 (shown in FIG. 3 as normally closed type valves) are used to actuate the low and medium pressure relief valves (206 and 208, respectively). If neither of the solenoids 216, 218 are actuated (i.e. opened), then clamp-closing pressure is limited by the pressure relief valve 210.

Preferably, the pressure relief valves 206, 208, 210 limit clamp-closing pressures to low, medium, and high pressure settings, respectively. For example, if the solenoid valve 216 is energized (to open the valve), the clamp-closing pressure will be limited to the (low) pressure setting of the relief valve 206. If the (low) pressure setting is exceeded, hydraulic fluid from the clamp-closing fluid conduit 254 will be diverted to the return-to-tank fluid conduit 234. If the solenoid valve 218 is energized, the clamp-closing pressure will be limited to the (medium) pressure setting of the bidirectional relief valve 208. Finally, if neither solenoid valve is opened, the clamp-closing pressure will be limited to the (high) pressure setting of the relief valve 210. By way of example, the three relief valves 206, 208, 210 may be set to provide maximum clamp-closing pressures of 300 psi, 800 psi, and 1500 psi, respectively.

Preferably, an override assembly is provided for automatically limiting the amount of clamp-closing pressure to prevent attempts by an operator to intentionally increase clamp-closing pressure above a maximum pressure relief setting by opening the clamp-closing control valve 250 rapidly (or "milking" the clamp-closing system). Preferably, anti-spike circuitry interconnected with the clamp-closing fluid conduit 254 includes a clamp-closing anti-spike bypass conduit 344 extending from the clamp-closing fluid conduit 254. As shown in FIG. 3, a pilot-operated normally open "tank dump" valve 346 provides a path for sudden flows (or spikes) of hydraulic fluid in the clamp-closing fluid conduit 254. The tank dump valve 346 diverts hydraulic fluid from the clamp-closing fluid conduit 254 to the return-to-tank fluid conduit 234 until pressure builds, with the help of a flow restrictor 348 positioned just before the tank dump valve 346, to a level sufficient to exceed the "delay relief" valve 350, thereby providing a pilot signal 352 for causing the tank dump valve 346 to close. The flow restrictor 354 from the pilot conduit 352 to the return-to-tank fluid conduit 234 provides restricted leakage for quick reopening of the tank dump valve after the clamp control valve 250 is closed.

The clamp-opening (or open) conduit 252 is preferably capable of receiving hydraulic fluid from the clamping hydraulic circuitry 324. In one embodiment, clamp-opening pressure is automatically limited by a pressure-regulating valve which also provides pressure relief for the clamp-closing fluid conduit 254. As shown, clamp-opening pressure is automatically limited to the pressure setting for the pressure relief valve 208. Hydraulic fluid received by the clamp-opening fluid conduit 252 is diverted to a clamp-opening pressure relief bypass conduit 338. The check valve 342 becomes unseated, directing hydraulic fluid to the pressure relief valve 208. A check valve 340 prevents the hydraulic fluid from the clamp-opening fluid conduit 252 from flowing back through the solenoid-operated valve 218 and into the clamp-closing fluid conduit 254. If the pressure in the clamp-opening fluid conduit 252 exceeds the pressure setting for the pressure relief valve 208, the excess pressure (and hydraulic fluid) is released through the pressure relief valve 208 into the return-to-tank fluid conduit 234.

If desired, side-shifting pressure could similarly be limited by a valve which also provides pressure regulation for the clamp-closing and/or clamp-opening functions.

Various alternative circuitry may be used in place of the specific circuitry shown in FIG. 3. For example, one or more computer-operated and/or hydraulic servo-operated proportional valve may be used to limit the clamp-closing pressure, clamp-opening pressure, and/or side-shifting pressure. More specifically, one or more proportional relief valve or pressure reducing valve may be used for limiting such pressure.

The hydraulic circuitry in FIG. 3 may be provided, as shown in FIGS. 1 and 2, as part of a system having a hydraulic valve module (or controller) 104. That is, hydraulic valve circuitry with damage-control override capabilities as in FIG. 3 may be provided as a retrofit system or system including a module and associated switches, visual indicators, wiring, and hydraulic conduits. Alternatively, the hydraulic valve circuitry with override capabilities as in FIG. 3 may be provided as an original equipment manufacturer system. For example, the hydraulic valve circuitry with damage-control override capabilities may be incorporated into a forklift or forklift clamping attachment or material handling vehicle having integral clamping and side-shifting capabilities.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

I claim:

1. A controller capable of variably limiting respective maximum hydraulic pressures at which an assembly of bidirectional hydraulic power devices selectively moves respective clamping members in a closing movement toward each other, in an opening movement away from each other, or in a side-shifting movement in unison with each other, said controller comprising:

(a) a pressure-regulating mechanism interconnected with said assembly of power devices, and capable of variably limiting a maximum side-shifting pressure, at which said assembly causes said side-shifting movement, in response to a side-shifting maximum pressure selection; and (b) at least one override assembly, capable of overriding said side-shifting maximum pressure selection to thereby lower said maximum side-shifting pressure automatically in response to said opening movement of said clamping members.

2. A controller capable of variably limiting respective maximum hydraulic pressures at which an assembly of bidirectional hydraulic power devices selectively moves respective clamping members in a closing movement toward each other, in an opening movement away from each other, or in a side-shifting movement in unison with each other, said controller comprising:

(a) a pressure-regulating mechanism interconnected with said assembly of power devices, and capable of variably limiting a maximum side-shifting pressure to one of a plurality of predefined settings, at which said assembly causes said side-shifting movement, in response to a remotely controlled side-shifting maximum pressure selection; and (b) at least one override assembly, capable of overriding said remotely controlled side-shifting maximum pressure selection to thereby change said maximum side-shifting pressure to a lower one of said plurality of predefined settings, automatically irrespective of said remotely controlled side-shifting maximum pressure selection.

3. A controller capable of variably limiting respective maximum hydraulic pressures at which an assembly of bidirectional hydraulic power devices selectively moves respective clamping members in a closing movement toward each other, in an opening movement away from each other, or in a side-shifting movement in unison with each other, said controller comprising:

(a) a pressure-regulating mechanism interconnected with said assembly of power devices, and capable of variably limiting a maximum side-shifting pressure, at which said assembly causes said side-shifting movement, in response to a side-shifting maximum pressure selection; and (b) at least one override assembly, capable of changing said maximum side-shifting pressure automatically in response to actuation of said opening movement, independently of the presence or absence of a clamped load.

4. A controller capable of variably limiting respective maximum hydraulic pressures at which an assembly of bidirectional hydraulic power devices selectively moves respective clamping members in a closing movement toward each other, in an opening movement away from each other, or in a side-shifting movement in unison with each other, said controller comprising:

(a) a pressure-regulating mechanism interconnected with said assembly of power devices, and capable of variably limiting a maximum side-shifting pressure, at which said assembly causes said side-shifting movement, in response to a side-shifting maximum pressure selection; and (b) at least one override assembly, capable of changing said maximum side-shifting pressure automatically, and retaining said change independently of the presence or absence of a clamped load and independently of the cessation of said actuation, where said at least one override assembly is disabled automatically in response to actuation of said closing movement.

5. A controller capable of variably limiting respective maximum hydraulic pressures at which an assembly of bidirectional hydraulic power devices selectively moves respective clamping members in a closing movement toward each other, in an opening movement away from each other, or in a side-shifting movement in unison with each other, said controller comprising:

(a) a pressure-regulating mechanism interconnected with said assembly of power devices, and capable of variably limiting a maximum side-shifting pressure, at which said assembly causes said side-shifting movement, in response to a side-shifting maximum pressure selection; and (b) at least one override assembly, capable of selectively regulating either a fixed maximum side-shifting pressure or a variable maximum side-shifting pressure, depending on whether said opening movement or said closing movement was most recently actuated.

6. A controller capable of variably limiting respective maximum hydraulic pressures to selected predefined settings, at which an assembly of bidirectional hydraulic power devices selectively moves respective clamping members in a closing movement toward each other, in an opening movement away from each other, or in a side-shifting movement in unison with each other, said controller comprising:

(a) a first pressure-regulating mechanism interconnected with said assembly of power devices, and capable of variably limiting a maximum side-shifting pressure, at which said assembly causes said side-shifting movement, in response to a maximum pressure selection;

(b) at least one override assembly, capable of overriding said maximum pressure selection to thereby change said maximum side-shifting pressure to a lower predefined setting, automatically irrespective of said maximum pressure selection; and (c) a second pressure-regulating mechanism interconnected with said assembly of power devices, and capable of variably limiting a maximum closing pressure, at which said assembly causes said closing movement, in response to said maximum pressure selection.

* * * * *